US008393764B2

(12) United States Patent
Yao

(10) Patent No.: US 8,393,764 B2
(45) Date of Patent: Mar. 12, 2013

(54) MULTILAYERED SURROUNDING PLATE TYPE HEAT DISSIPATING STRUCTURE

(75) Inventor: Pei-Chih Yao, Jhonghe (TW)

(73) Assignee: ACPA Energy Conversion Devices Co., Ltd., Jhonghe, Taipei County (TW)

( * ) Notice: Subject to any disclaimer, the term of this patent is extended or adjusted under 35 U.S.C. 154(b) by 406 days.

(21) Appl. No.: 12/725,011

(22) Filed: Mar. 16, 2010

(65) Prior Publication Data

US 2010/0236751 A1 Sep. 23, 2010

(30) Foreign Application Priority Data

Mar. 17, 2009 (TW) ..... 98204177 U

(51) Int. Cl.
*F21V 29/00* (2006.01)

(52) U.S. Cl. ..... 362/373; 362/147; 362/294; 362/364; 362/365; 362/249.02

(58) Field of Classification Search ..... 362/147, 362/294, 373, 364, 365
See application file for complete search history.

(56) References Cited

U.S. PATENT DOCUMENTS 7,878,692 B2 * 2/2011 Soderman et al. ..... 362/373

* cited by examiner

*Primary Examiner* — Stephen F Husar
*Assistant Examiner* — James Cranson, Jr.
(74) *Attorney, Agent, or Firm* — Muncy, Geissler, Olds & Lowe, PLLC

(57) ABSTRACT

A multilayer surrounding plate type heat dissipating structure comprises: a heat dissipating base module; a heat conducting insert, with an end coupled to the heat dissipating base module, and another end having a distal head portion; at least one light emitting element, installed at the distal head portion of the heat conducting insert; and a multilayer surrounding plate, installed to a ceiling, and having a through hole formed thereon, for passing the heat conducting insert, such that a heat source produced by the light emitting element can be dissipated through the multilayer surrounding plate or an airflow passage between multilayer surrounding plate to achieve an excellent heat dissipating effect, assure the functions of the light emitting element, and extend their lifespan.

8 Claims, 4 Drawing Sheets

MULTILAYERED SURROUNDING PLATE TYPE HEAT DISSIPATING STRUCTURE

BACKGROUND OF THE INVENTION

1. Field of the Invention

The present invention relates to a heat dissipating structure, and more particularly to a light emitting source heat dissipating structure that combines a light emitting element with a multilayer plate installed at a light steel frame of a ceiling to provide an excellent heat dissipating effect.

2. Description of the Related Art

Due to energy crisis, traditional incandescent lamps are sold less and less in the illumination equipment market. Furthermore, environmental protection becomes increasingly serious, and the mercury pollution issue of the incandescent lamps is brought to our attention.

In recent years, green optoelectric products become a hot industry, and thus the development of light emitting diodes (LED) having the advantages of high efficiency, power saving, long lifespan, cool light without infrared spectrum, quick response and color consistency over the traditional light emitting elements plays an important role in the industry, and the light emitting diodes are used extensively in the area of illumination, and the LED, which is a main research and development subject for the illumination industry, gradually substitutes the application of traditional incandescent lamps. Therefore, the lifespan and function of the light emitting diode relates to the heat dissipation of the light emitting diode, and the heat dissipation is a key factor of the development and application of the light emitting diode. To overcome the heat dissipation issue of the conventional light emitting diode, a light emitting diode is combined with a heat dissipating base, wherein the heat dissipating base further includes a plurality of heat dissipating fins for achieving the heat dissipating effect of guiding and eliminating the heat flow from the heat dissipating fins. Therefore, the heat dissipation technology of the conventional light emitting diode has the heat dissipating effect to a certain level, but it is necessary to match with the appearance and size of the existing light bulb (such as incandescent lamps with MR16 or another specification, so that the heat cannot be dissipated efficiently, or the working efficiency cannot be improved effectively.

Therefore, it is an important subject for manufacturers and designers of the related industry to overcome the shortcomings of the application of the conventional heat dissipating structure of the light emitting element.

In view of the shortcomings of the application and the deficiency of the structural design of the conventional heat dissipating structure of a light emitting element, the inventor of the present invention based on years of experience in the related industry to conduct extensive researches and experiments, and finally developed a multilayer surrounding plate type heat dissipating structure in accordance with the present invention, in hope of enhancing the heat dissipating effect, providing an economic and practical service to the general public, and promoting the development of the industry.

SUMMARY OF THE INVENTION

Therefore, it is a primary objective of the present invention to dissipate and conduct a heat source of a light emitting element (particularly a light emitting diode) through the existing space or airflow passage on an indoor ceiling to achieve an excellent heat dissipating effect, so as to assure the function and lifespan of using the light emitting element.

Another objective of the present invention is to provide a multilayer surrounding plate type heat dissipating structure, capable of combining multilayer air entry and exit of air conditioning equipments to provide an excellent heat dissipation operation and aggressively achieve a convenient application of the light emitting element for indoor illuminations.

A further objective of the present invention is to provide a multilayer surrounding plate type heat dissipating structure capable of using the reflection of the multilayer surrounding plate to improve the brightness and the light uniformity, so as to provide an enhanced illumination effect.

To achieve the foregoing objective, the present invention provides a multilayer surrounding plate type heat dissipating structure comprising: a heat dissipating base module; a heat conducting column, with an end coupled to the heat dissipating base module, and another end having a distal head portion; at least one light emitting element, installed at the distal head portion of the heat conducting column; a multilayer surrounding plate, having a through hole formed thereon, for passing the heat conducting column, and the multilayer surrounding plate being installed on a ceiling or applied to an air outlet/inlet frame of an air conditioner installed on a ceiling.

The foregoing and other technical characteristics of the present invention will become apparent with the detailed description of the preferred embodiments and the illustration of the related drawings.

DETAILED DESCRIPTION OF THE PREFERRED EMBODIMENTS

Figure 1:
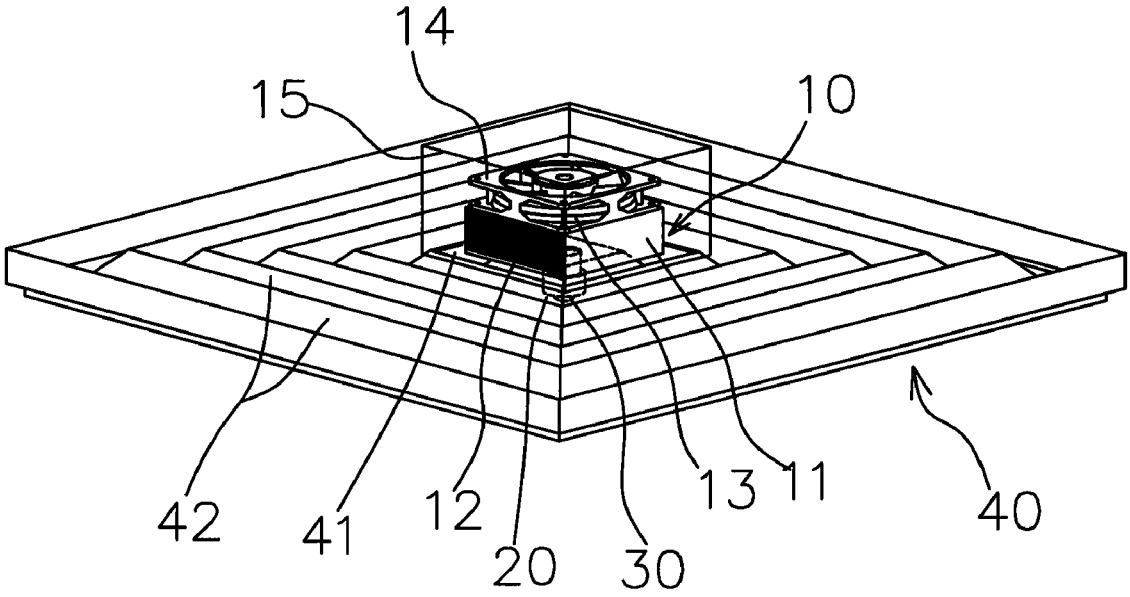
FIG. 1 is a perspective view of the present invention.
Figures 2, 2A:
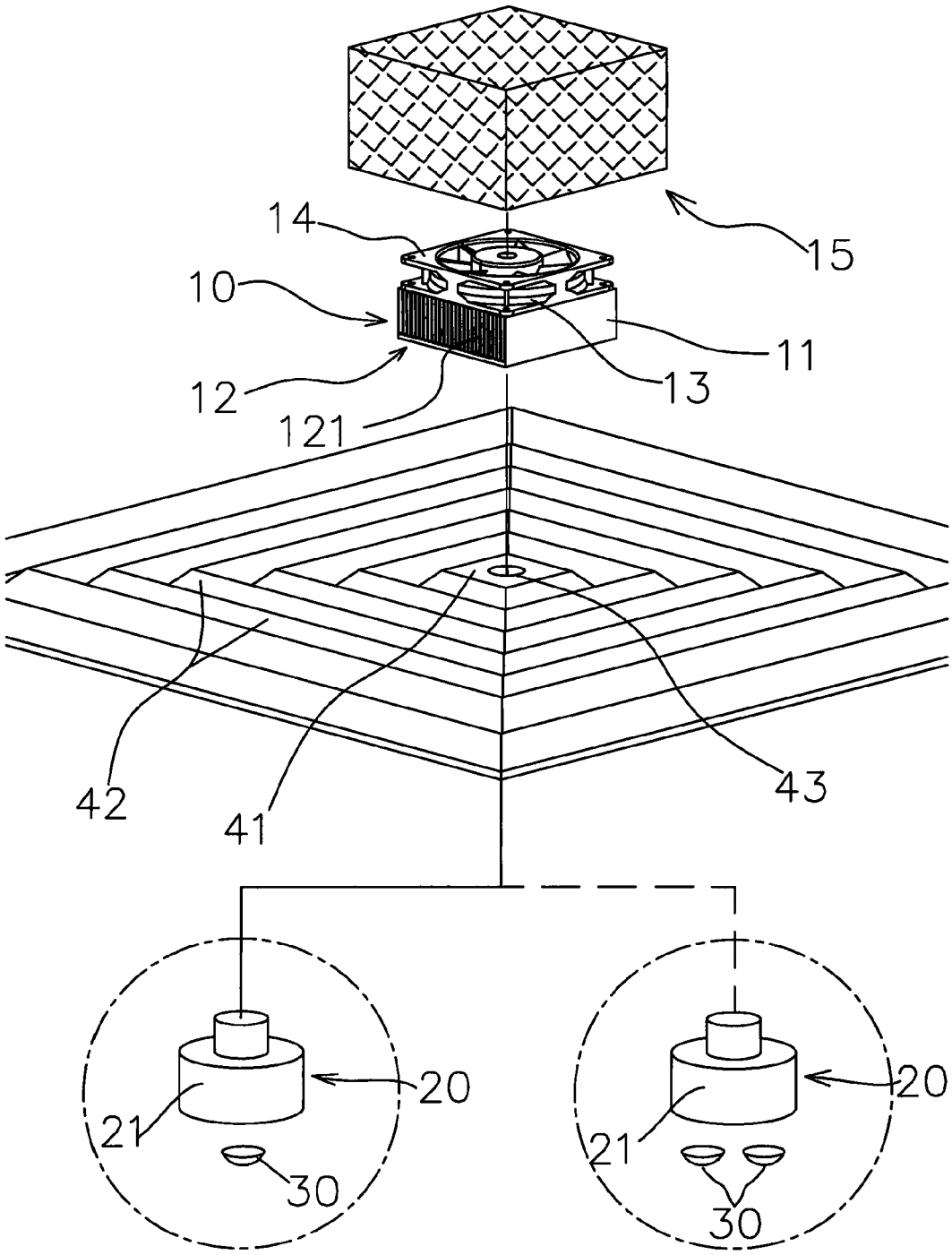
FIG. 2 is an exploded view of the present invention.
FIG. 2A is a schematic view of a plurality of light emitting diodes in accordance with a preferred embodiment of the present invention.
Figure 3:
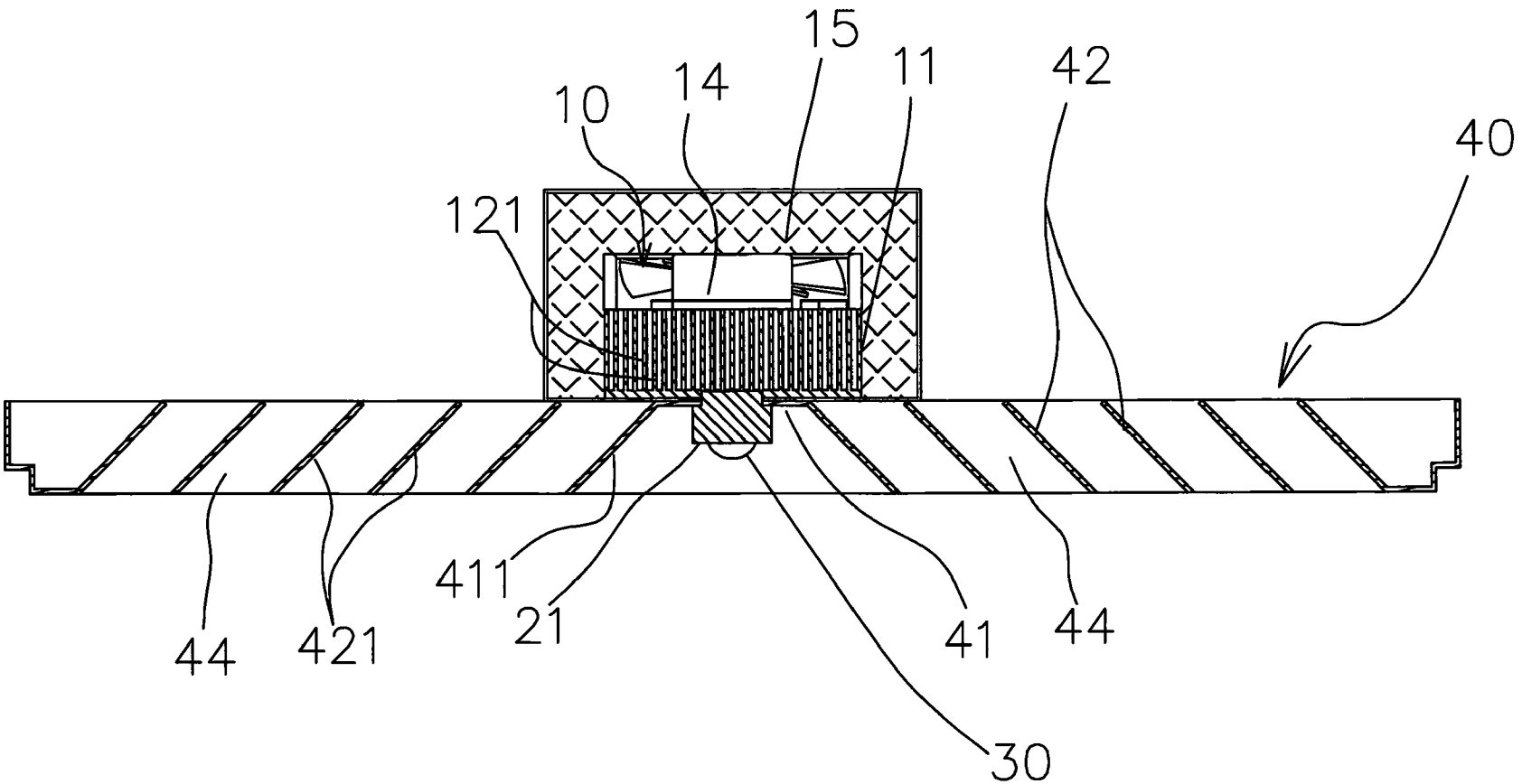
FIG. 3 is a cross-sectional view of the present invention.

With reference to FIGS. 1 to 3 for a multilayer surrounding plate type heat dissipating structure of the present invention, the structure comprises a heat dissipating base module 10, a heat conducting column 20, a light emitting element 30 and a multilayer surrounding plate 40.

The heat dissipating base module 10 includes a base 11 made of a metal, ceramic, plastic or highly heat conductive composite material, wherein the base 11 of this preferred embodiment is a heat dissipating base; at least one lateral heat dissipation vent 12 and distal heat dissipation vent 13 (including upper and lower ends), and a plurality of heat dissipating fins 121 installed between the lateral heat dissipation vent 12 and the distal heat dissipation vent 13, and the base 11 includes a fan 14 installed at the top or on a lateral side of the base 11 and corresponding to the lateral heat dissipation vent 12 or the distal heat dissipation vent 13, such that external air can be used for driving and expediting the dissipation of a heat source. In addition, the heat dissipating base module 10 includes related circuit boards and electronic components (not shown in the figure).

In another preferred embodiment, the base 11 can be combined with a filter element 15 installed to the fan 14 and an external side of the base 11, wherein the filter element 15 can be a filter net or a filter made of a material capable of filtering dusts in the air.

An end of the heat conducting column 20 is coupled to the heat dissipating base module 10 (or coupled to the base 11 in this embodiment), wherein the heat conducting insert 20 is made of a metal, ceramic, plastic or highly heat conductive composite material, another end of the heat conducting column 20 includes a distal head portion 21.

The light emitting element 30 is installed at the distal head portion 21 of the heat conducting column 20, wherein the light emitting element 30 is a light emitting diode in this embodiment, and the light emitting element 30 is electrically coupled to related circuit boards and electronic components of the heat dissipating base module 10, and the light emitting element 30 as shown in FIG. 2A is composed of a plurality of light emitting diodes.

The multilayer surrounding plate 40 includes a base plate portion 41 disposed at the central position of the multilayer surrounding plate 40 and a plurality of enclosing plates 42 coupled around the periphery of the base plate portion 41, and the base plate portion 41 includes a through hole 43, an air gap 44 formed separately between the base plate portion 41 and the enclosing plate 42 and among the plurality of enclosing plates 42. In FIG. 3, the base plate portion 41 and the enclosing plate 42 have oblique surface portions 411, 421 respectively, and the oblique surface portions 411, 421 are coated with a reflecting layer (not shown in the figure) to achieve a better light reflecting effect. In addition, the multilayer surrounding plate 40 could be made of a thermal conductive material for achieving the better heat dissipation function.

The multilayer surrounding plate 40 can be installed at an interval of a light steel frame of a ceiling, or directly applied to a multilayer air outlet/inlet frame of an air conditioner installed on a ceiling to achieve the overall economic application. When the multilayer surrounding plate type heat dissipating structure of the present invention is combined, the heat conducting insert 20 coupled to the bottom of the heat dissipating base module 10 (or the base 11) is passed through the through hole 43 of the multilayer surrounding plate 40 (or the base plate portion 41), such that the distal head portion 21 is protruded out from the base plate portion 41 (or the bottom), and the light emitting element 30 can be used for illuminations, and the multilayer surrounding plate 40 is fixed to a air-conditioning airflow passage of a ceiling 50 (as shown in FIG. 4).

Figure 4:
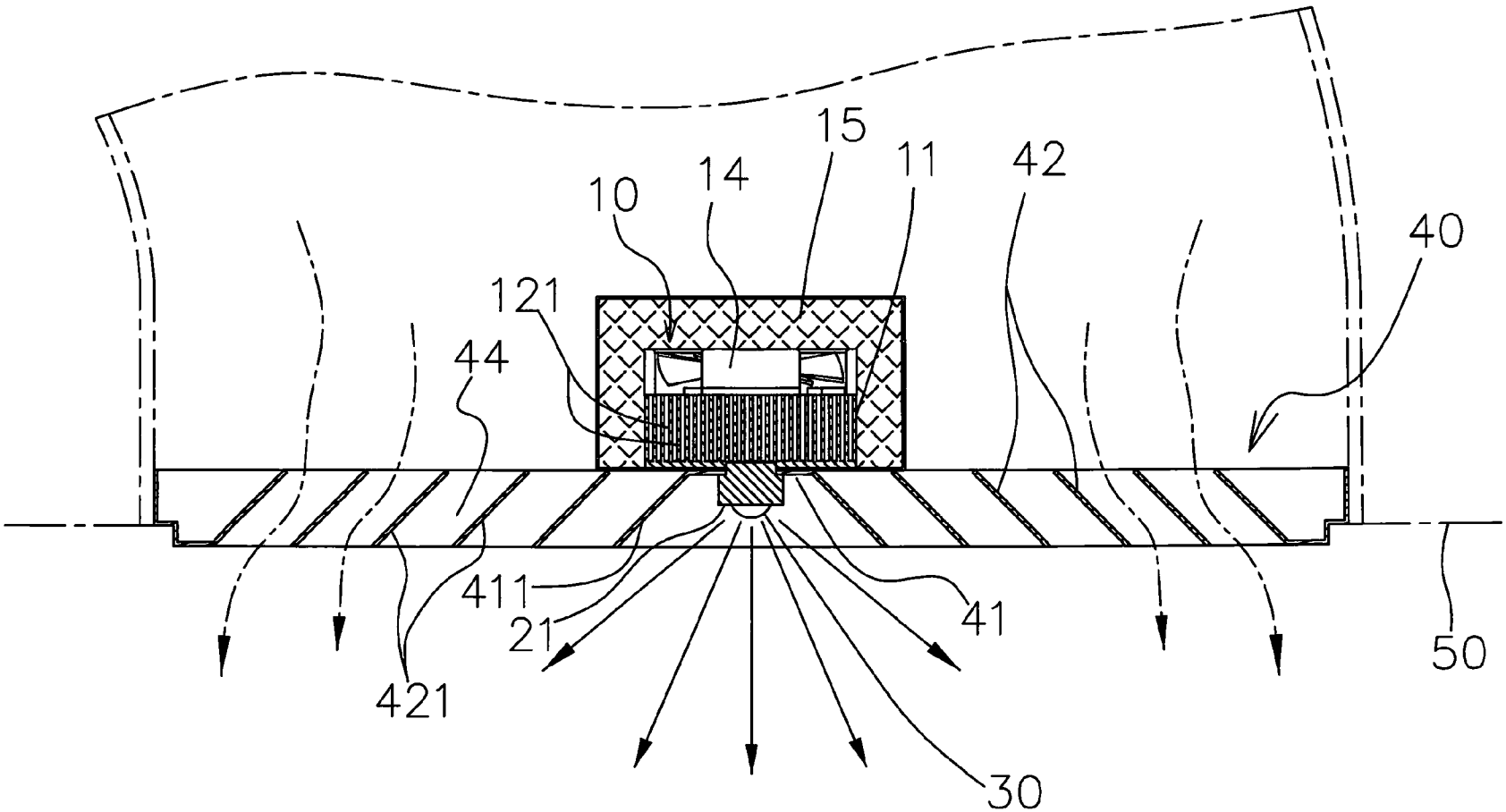
FIG. 4 is a schematic view of an application of the present invention.

With reference to FIG. 4, a heat source produced by the light emitting element 30 is guided to the multilayer surrounding plate 40 and the base 11 by the heat conducting insert 20 of the multilayer surrounding plate type heat dissipating structure of the present invention. Since the multilayer surrounding plate 40 and the base 11 can be installed onto the ceiling 50 or a position of a multilayer air outlet/inlet frame of an air conditioner installed onto the ceiling 50, therefore the present invention can use the air flow in existing spaces on the ceiling and the ceiling itself to blow or suck the heat source produced by the light emitting element 30 to pass through the air gap 44 and eliminate the heat source quickly to achieve an excellent heat dissipating effect. In addition, the present invention uses existing air flow of the air conditioner and incurs no additional power or cost, and thus providing an economic heat dissipating operation. If the air conditioner is not in use, the multilayer surrounding plate 40 and the base 11 still can be used for dissipating heat, and the fan 14 can be turned on for dissipating heat. Of course, the air conditioner can be operated together with the fan 14 for dissipating heat to achieve the best heat dissipating effect, so as to extend and assure the function and lifespan of the light emitting element.

Since the oblique surface portions 411, 421 of the multilayer surrounding plate 40 could be coated with a reflecting layer, the reflection from the reflecting layer of the multilayer surrounding plate 40 can be used for improving the overall brightness and light uniformity, so as to achieve an enhanced illumination effect. In addition, the present invention uses an existing air-conditioning airflow passage and multilayer surrounding plate to provide a highly economic heat dissipating operation extensively used for the applications of indoor illuminations.

In view of the description above, the present invention improves over the prior art and complies with patent application requirements, and thus is duly filed for patent application. While the invention has been described by device of specific embodiments, numerous modifications and variations could be made thereto by those generally skilled in the art without departing from the scope and spirit of the invention set forth in the claims.

What is claimed is:

1. A multilayer surrounding plate type heat dissipating structure, comprising:

a heat dissipating base module;

a heat conducting insert, with an end coupled to the heat dissipating base module, and another end of the heat conducting column having a distal head portion;

at least one light emitting element, installed at the distal head portion of the heat conducting insert; and a multilayer surrounding plate, having a through hole for passing the heat conducting insert, and the multilayer surrounding plate being installed at a ceiling, wherein the heat dissipating base module includes a base for dissipating heat from the light emitting element, and wherein the base includes at least one lateral heat dissipation vent and distal heat dissipation vent, and the lateral heat dissipation vent includes a plurality of heat dissipating fins.

2. The multilayer surrounding plate type heat dissipating structure of claim 1, wherein the multilayer surrounding plate is a multilayer air outlet/inlet frame that conditions the air.

3. The multilayer surrounding plate type heat dissipating structure of claim 1, wherein the base further includes a fan corresponding to the distal heat dissipation vent.

4. The multilayer surrounding plate type heat dissipating structure of claim 3, wherein the base includes a filter element coupled thereon.

5. The multilayer surrounding plate type heat dissipating structure of claim 1, wherein the base and the heat conducting insert are made of a metal, ceramic or highly heat conducting composite material.

6. The multilayer surrounding plate type heat dissipating structure of claim 1, wherein the light emitting element is a light emitting diode electrically coupled to the heat dissipating base module.

7. The multilayer surrounding plate type heat dissipating structure of claim 1, wherein the multilayer surrounding plate includes a base plate portion with the through hole, a plurality of enclosing plates coupled around the periphery of the base plate portion, and an air gap formed separately between the base plate portion and the enclosing plate, and between the enclosing plate and the enclosing plate.

8. The multilayer surrounding plate type heat dissipating structure of claim 7, wherein the enclosing plate has an oblique surface portion coated with a reflecting layer.

* * * * *